United States Patent [19]

Felle

[11] Patent Number: 4,654,046

[45] Date of Patent: Mar. 31, 1987

[54] CONTINUOUS PROCESS FOR DYEING CELLULOSE/POLYAMIDE BLENDS: THERMOBOL PAD LIQUOR CONTAINING NONIONIC SURFACTANT

[75] Inventor: Hellmut Felle, Oberwil, Switzerland

[73] Assignee: Ciba-Geigy Corporation, Ardsley, N.Y.

[21] Appl. No.: 811,810

[22] Filed: Dec. 20, 1985

Related U.S. Application Data

[63] Continuation of Ser. No. 692,149, Jan. 17, 1985, abandoned.

[51] Int. Cl.[4] ..... D06P 3/87; D06P 1/52

[52] U.S. Cl. ..... 8/531; 8/642; 8/650; 8/685; 8/918; 8/924

[58] Field of Search ..... 8/531, 642, 650, 685

[56] References Cited

U.S. PATENT DOCUMENTS 3,653,801 4/1972 Aboul-Saad ..... 8/531
3,993,437 11/1976 Dickmanns et al. ..... 8/531

FOREIGN PATENT DOCUMENTS 2334014 1/1974 Fed. Rep. of Germany .
2921949 12/1980 Fed. Rep. of Germany .
896019 5/1962 United Kingdom .

OTHER PUBLICATIONS

J. C. King, Continuously Dyeing Nylon/Cellulosic Blends in Textile Chemist and Colorist 2: pp. 60–62 (1970).

CA 99: 55028q, No. 8, Composition for Dyeing Cellulose Fiber Blends, (1983).

*Primary Examiner*—A. Lionel Clingman
*Attorney, Agent, or Firm*—Edward McC. Roberts; Meredith C. Findlay

[57] ABSTRACT

The invention relates to a thermosol pad-steam process for the continuous dyeing of cellulose/polyamide blends, which comprises impregnating said blends with a pad liquor which contains a non-ionic surfactant or a mixture of non-ionic surfactants, in addition to at least one vat dye and at least one metal complex dye and optionally further auxiliaries.

This process is particularly suitable for dyeing large yardages.

10 Claims, No Drawings

CONTINUOUS PROCESS FOR DYEING CELLULOSE/POLYAMIDE BLENDS: THERMOBOL PAD LIQUOR CONTAINING NONIONIC SURFACTANT

This is a continuation of application Ser. No. 692,149 filed on Jan. 17, 1985, now abandoned.

The present invention relates to a process for the continuous dyeing of cellulose/polyamide blends, to the pad liquor employed for carrying out this process, and to the textile material dyed by this process.

Cellulose/polyamide blends are usually dyed by the two-bath method: for example in a first step by the pad-steam process to dye the cotton component and then by the exhaust process to dye the polyamide component, or vice versa (q.v. W. Bernard, Praxis des Bleichens und Färbens von Textilien, Springer 1966, p.368 et seq.). However, this process is time-consuming and laborious when dyeing large yardages.

On the other hand, the efficient thermosol pad-steam process has gained general acceptance for the continuous dyeing of polyester/cotton blends. In this process, the textile material is initially impregnated with a pad liquor that already contains a combination of polyester and cotton dyes. However, if this process is used for dyeing cotton/polyamide blends and the fabric is padded with a liquor that contains dyes suitable for these substrates, then the result is that the cellulosic component is dyed perfectly satisfactorily but the polyamide component is only superficially dyed, in fact merely stained, i.e. the dye has not diffused into the fibres under these conditions.

Hence it is the object of the present invention to provide a process for dyeing cellulose/polyamide blends, which process makes it possible to dye both types of fibre continuously in a single bath and in one operation.

It has now been found that it is also possible to dye the polyamide component of cellulose/polyamide blends satisfactorily by the thermosol pad-steam process by adding a non-ionic surfactant or mixture of non-ionic surfactants to the padding liquor.

Accordingly, the invention relates to a continuous process for dyeing cellulose/polyamide blends by the thermosol pad-steam method, which process comprises impregnating said blends with a pad liquor that contains a non-ionic surfactant or a mixture of non-ionic surfactants, in addition to at least one vat dye and at least one metal complex dye, and optionally further auxiliaries.

Suitable non-ionic surfactants are preferably adducts of ethylene oxide with alkyl phenols, fatty alcohols, fatty amines or fatty acids (ethoxylates); as well as polyethylene glycols. The molecular weight of the ethylene oxide adducts varies from 500 to 10,000, and that of the polyethylene glycols from 200 to 6,000.

Preferred ethylene oxide adducts are:

(a) adducts of saturated and/or unsaturated $C_{10}$–$C_{20}$fatty alcohols with 5 to 40 moles of ethylene oxide per mole of fatty alcohol;

(b) adducts of $C_4$–$C_{12}$alkylphenols with 5 to 40 moles, preferably 5 to 15 moles, of ethylene oxide per mole of alkylphenol;

(c) adducts of saturated and/or unsaturated $C_{14}$–$C_{25}$fatty amines with 10 to 40 moles of ethylene oxide per mole of fatty amine;

(d) adducts of saturated and/or unsaturated $C_{14}$–$C_{20}$fatty acids with 5 to 40 moles of ethylene oxide per mole of fatty acid.

Of the above ethylene oxide adducts, those under (a) are preferred, namely those having a molecular weight of 800 to 1500.

Mixtures of the ethylene oxide adducts in (a), (b), (c) and (d) with each other can also be used. Such mixtures are obtained by mixing individual adducts or direct by ethoxylating a mixture of compounds from which the adducts are derived. It will, of course, be understood that mixtures of ethylene adducts within a group are also suitable, for example those obtained by ethoxylating a mixture of fatty alcohols of varying chain length.

Suitable saturated or unsaturated fatty alcohols in (a) are dodecanol, palmityl alcohol, stearyl alcohol, oleyl alcohol or tallow fatty alcohol, preferably a mixture of $C_{12}$–$C_{19}$fatty alcohols.

Suitable alkylphenols in (b) are butylphenol, hexylphenol, and preferably isooctylphenol, p-tert-octylphenol, nonylphnol and dodecylphenol.

Representative fatty amines in (c) are, in addition to stearylamine, for example palmitylamine and oleylamine and, in particular, a mixture of $C_{18}$–$C_{22}$fatty amines.

Suitable saturated and/or unsaturated fatty acids in (d) are for example palmitic acid, preferably stearic acid and oleic acid.

Of the polyethylene glycols it is preferred to use the low molecular compounds, e.g. those having a molecular weight from 300 to 500.

It is advantageous to add the non-ionic surfactant to the padding liquor in an amount of 2 to 50 g/l, preferably from 5 to 20 g/l.

Exemplary of suitable vat dyes for dyeing cellulosic fibre components are vattable polycylic quinones of the following classes:

Representative examples of vattable polycyclic quinones are: perylenetetracarboximides, in particular the phenylimides, anthrapyrimidines, anthrapyridones, isothiazolanthrones, quinazolinanthraquinones, oxazolanthraquinones, thiazolanthraquinones, oxdiazolanthraquinones, anthraquinonyltriazoles, pyrazolanthraquinones, dipyrazolanthronyls, pyrazinoanthraquinones, azabenzanthrones, indanthrones, thioxanthronanthraquinones, anthraquinonaccridones, dihydroacridines, anthanthrones, pyranthrones, flavanthrones, acedianthrones and, in particular, anthrimides, anthrimidecarbazoles, phthaloylacridines and the anthraquinones themselves, comprising not only derivatives containing pure 9,10-dioxoanthracene rings but also those containing thiophanthrone radicals and the like, as well as anthraquinone compounds which contain 9,10-dioxoanthracene rings. All these polycyclic compounds can carry the customary substituents of vat dyes. Such substituents are for example halogen atoms, in particular chlorine, fluorine or bromine atoms, and alkyl, alkoxy, aryl, aryloxy, aralkyl, aralkoxy, carbalkoxy, arylamino, alkylmercapto, arylmercapto, cyano and thiocyano groups. Alkyl denotes in particular radicals containing 1 to 4 carbon atoms and aryl denotes in particular radicals such as phenyl, toluyl, chlorophenyl, methoxyphenyl or naphthyl radicals; and aralkyl is preferably the benzyl radical. Particularly important substituents are furthermore the acyl and acylamino group.

Suitable metal complex dyes with which the polyamide component is dyed are for example 1:1 or 1:2 metal complexes of azo or azomethine dyes or metallised phthalocyanines such as copper phthalocyanine or nickel phthalocyanine. Preferred 1:1 and 1:2 metal complexes are 1:1 nickel complexes, 1:1 cobalt complexes, 1:1 copper complexes, 1:1 chromium complexes, 1:1 iron complexes or symmetrical or asymmetrical 1:2 cobalt complexes, 1:2 iron complexes or 1:2 chromium complexes, which complexes carry as chromophoric ligands e.g. o-carboxy-o'-hydroxyazo dyes, o-hydroxy-o'-aminoazo dyes or o,o'-dihydroxyazo dyes of the benzene-azobenzene, naphthalene-azonaphthalene, benzene-azonaphthalene, benzene-azopyrazolone, benzene-azopyridine or benzene-azoacetoacetamide type, which dyes may be unsubstituted or substituted. Examples of possible substituents are: carboxyl and sulfo groups, unsubstituted or substituted sulfonamides or alkylsulfones, halogen atoms or the nitro, acetyl or acetamido group, and also alkyl radicals such as the methyl, ethyl or propyl radical.

The azo dyes may be monoazo, disazo or polyazo dyes. In asymmetrical 1:2 metal complex dyes, colourless ligands such as bidentate hydroxyquinoline derivatives are also suitable in addition to the azo dyes.

It is preferred to use 1:2 metal complex dyes in the process of this invention.

As further auxiliaries the padding liquor may contain in particular migration inhibitors, e.g. hypophosphite-acrylic acid telomers or those based on polyacrylate, as these effectively inhibit side-to centre shading effects and two-sided effects. Further suitable auxiliaries are buffer substances, e.g. ammonium sulfate, sodium hydrogen phosphate and sodium dihydrogen phosphate, acids, e.g. acetic acid, and/or light stabilisers.

The procedure for carrying out the the dyeing process of the present invention is as follows:

The cellulose/polyamide blend, for example a 1:1 blend of cotton and polyamide, preferably polyamide 6.6, is first impregnated with the pad liquor. Depending on the depth of the desired shade, the pad liquor contains about 50 g/l of dye, about 10 g/l of fatty alcohol ethoxylate and, advantageously, about 5 g/l of a migration inhibitor. The fabric is then pinched off to a pick-up of about 60% and subjected to an intermediate drying, for example with dry air at 100°–130° C. The metal complex dye is then fixed on the polyamide component by thermosol fixation by subjecting the fabric to dry heat for 30 to 120 seconds in the temperature range from 190° to 230° C. This is done for example using a stenter frame or in a thermo-hot flue, with or without width control. Other possibilities are cylinder fixation (oil-heated adjacent and superposed drying cylinders) or also the use of perforated drum dryers.

The fixation of the vat dye follows immediately. The fabric is first impregnated with a chemical pad liquor in which the vat dye is converted, in the presence of alkali, with hydrosulfite into the water-soluble leuco-form. The fabric then enters the air-free steamer and is steamed for about 1 minute at 100° C. (saturated steam). After leaving the steamer, the fabric passes into the open-width washing machine, where the dyeing is rinsed, oxidised and soaped.

The dyeings obtained by the process of this invention on cellulose/polyamide blends with the combination of vat dyes/metal complex dyes, in the presence of specific surfactants, are distinguished by outstanding general fastness properties, in particular by very good lightfastness and fastness to weathering, and by very good wetfastness properties. In addition, and in particular, the process of this invention is most suitable for dyeing long yardages. Compared with the state of the art referred to at the outset, this feature constitutes a saving in time, is less expensive and, in addition, saves energy, while at the same time a better conformity of shade is obtained. It is also surprising that the dyeing obtained on the polyamide component is not impaired by the subsequent development of the vat dye on the cotton component. The polyamide component dyed with the metal complex dye withstands the treatment with the reducing agent substantially unimpaired. There is virtually no deterioration of the dye and no change of shade.

The following Examples serve to illustrate the invention. Amounts of dye refer to commercially available, i.e. diluted, goods.

EXAMPLE 1

A polyamide 6.6/cotton blend (50:50) is dyed by the thermosol pad-steam process in a continuous machine. The pad liquor contains the following dyes and auxiliaries, the amounts in each case being based on 1 liter of liquor: 5 g of C.I. Vat orange 11 (C.I. 70805), 5.5 g of C.I. Vat Green (C.I. 69510), 23 g of C.I. Vat Black 25 (C.I. 69525), 3 g of C.I. Acid Yellow 220 (C.I. 11714), 2 g of the dye of formula I

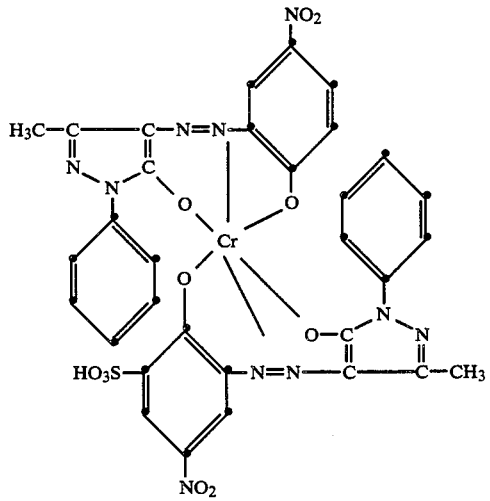

(I)

and 14 g of the dye of formula II

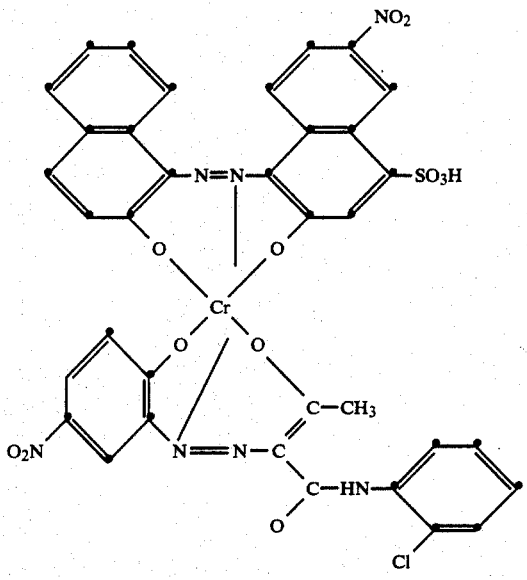

(II)

as well as 10 g of the fatty alcohol ethoxylate (mol. wt. ~1050) of the formula R-O-$(CH_2CH_2O)_nH$, wherein R is $C_{11}$–$C_{18}$alkyl and n is an average value of 18, 5 g of 2-acrylamido-2-methylpropanesulfonic acid polymer as potassium salt (migration inhibitor) and 2 g of sodium dihydrogen phosphate. The pH of the pad liquor is adjusted to 5.5 with acetic acid. After the textile material has been padded with the liquor of the above composition (pick-up 60%), it is subjected to an intermediate drying (hot flue at 110°–130° C.) and then to a thermosol treatment in a thermo-hot flue for 1 minute at 210°–220° C. The web of material then passes through the pad-steam machine in which the vat dyes are fixed. The goods are first treated with the chemical pad liquor which contains alkali, e.g. sodium hydroxide solution, and hydrosulfite in the requisite amounts for reducing the vat pigments. The goods are then passed into the air-free steamer, where they are steamed for 1 minute at 100° C. (saturated steam). After leaving the steamer, the goods then pass through the individual compartments of an open-width washing machine where the dyeing is finished by rinsing, oxidation and soaping. The textile material is dyed in a level olive shade of excellent fastness to weathering and light and excellent wetfastness properties.

EXAMPLES 2 TO 6

The procedure described in Example 1 is repeated, except that the pad liquor contains an equal amount (10 g/l) of one of the following non-ionic surfactants instead of the fatty alcoholate ethoxylate. An olive dyeing of excellent fastness to weathering and light and excellent wetfastness properties is also obtained.

| Example | Non-ionic surfactant |
|---|---|
| 2 | adduct of N—stearyl-N',N''—bis(phenylhydroxyethyl)-diethylenetriamine with 106 moles of ethylene oxide (30% aqueous solution) |
| 3 | adduct of $C_{20}$–$C_{22}$ fatty amine with 34.5 moles of ethylene oxide (33% aqueous solution) |
| 4 | adduct of p-tert-octylphenol with 8.2 moles of ethylene oxide |
| 5 | adduct of stearyl alcohol with 36 moles of ethylene oxide |
| 6 | polyethylene glycol (mol. wt. 400) |

What is claimed is:

1. A thermosol pad-steam process for the continuous dyeing of cellulose/polyamide blends, which comprises impregnating said blends with a pad liquor which contains at least one non-ionic surfactant, at least one vat dye and at least one metal complex dye.

2. A process according to claim 1, wherein the non-ionic surfactant is an alkylphenol ethoxylate, a fatty alcohol ethoxylate, a fatty acid ethoxylate or a fatty amine ethoxylate, each having a molecular weight of 500 to 10,000, or a polyethylene glycol having a molecular weight of 200 to 6,000.

3. A process according to claim 2, wherein the non-ionic surfactant is a fatty alcohol ethoxylate having a molecular weight of 800 to 1500.

4. A process according to claim 1, wherein the pad liquor contains the non-ionic surfactant in an amount of 2 to 50 g/l.

5. A process according to claim 1, wherein the vat dyes are selected from the class of the anthrimides, anthrimidecarbazoles, anthraquinones or phthaloylacridines, and the metal complex dyes are 1:2 metal complex dyes.

6. A process according to claim 1, wherein migration inhibitors, buffer substances, acids or light stabilisers are used as further auxiliaries.

7. A pad liquor for carrying out the process according to claim 1, which liquor contains one or more vat dyes, one or more metal complex dyes, a non-ionic surfactant or a mixture of non-ionic surfactants, and optionally further auxiliaries.

8. A padding liquor according to claim 7, which contains a migration inhibitor as further auxiliary.

9. A cellulose/polyamide blend dyed by the process according to claim 1.

10. A process according to claim 4 wherein the amount of surfactant is 5 to 20 g/l.

* * * * *